US005463793A

United States Patent [19]

Westfall

[11] Patent Number: 5,463,793

[45] Date of Patent: Nov. 7, 1995

[54] SASH SHOE SYSTEM FOR CURL SPRING WINDOW BALANCE

[75] Inventor: Norman R. Westfall, Rochester, N.Y.

[73] Assignee: Caldwell Manufacturing Company, Rochester, N.Y.

[21] Appl. No.: 280,491

[22] Filed: Jul. 26, 1994

Related U.S. Application Data

[62] Division of Ser. No. 40,457, Apr. 1, 1993, Pat. No. 5,353, 548.

[51] Int. Cl.[6] ..... E05F 1/08; E05D 13/00

[52] U.S. Cl. ..... 16/197

[58] Field of Search ..... 16/193, 197, DIG. 16, 16/76; 49/445, 446

[56] References Cited

U.S. PATENT DOCUMENTS

| | | | |
|---|---|---|---|
| 2,609,193 | 9/1952 | Foster . | |
| 2,635,282 | 4/1953 | Trammell, Sr. et al. . | |
| 2,644,193 | 7/1953 | Anderberg | 16/197 |
| 2,684,499 | 7/1954 | Lewis . | |
| 2,732,594 | 1/1956 | Adams et al. . | |
| 2,739,344 | 3/1956 | Dickinson . | |
| 2,817,872 | 12/1957 | Foster . | |
| 2,873,472 | 2/1959 | Foster . | |
| 3,150,420 | 9/1964 | Brenner | 49/445 |
| 3,445,964 | 5/1969 | Foster . | |
| 3,452,480 | 7/1969 | Foster . | |
| 3,475,865 | 11/1969 | Arnes . | |
| 3,820,193 | 6/1974 | Foster . | |
| 3,869,754 | 3/1975 | Foster . | |
| 3,992,751 | 11/1976 | Foster et al. . | |
| 4,089,085 | 5/1978 | Fitzgibbon | 16/197 |
| 4,227,345 | 10/1980 | Durham, Jr. | 49/181 |
| 4,935,987 | 6/1990 | Sterner, Jr. . | |
| 4,953,258 | 9/1990 | Mennuto . | |
| 4,961,247 | 10/1990 | Leitzel et al. . | |
| 5,119,591 | 6/1992 | Sterner, Jr. et al. | 49/445 X |
| 5,157,808 | 10/1992 | Sterner, Jr. . | |
| 5,210,976 | 5/1993 | Cripps | 49/445 X |
| 5,232,208 | 8/1993 | Braid et al. | 16/197 X |

*Primary Examiner*—P. Austin Bradley
*Assistant Examiner*—Chuck Y. Mah
*Attorney, Agent, or Firm*—Eugene Stephens & Associates

[57] ABSTRACT

A window balance system for a tilt sash uses a pair of constant force curl springs having curled convolutions carried by sash shoes and free end regions mounted in sash shoe channels above the region of travel of the shoes. The recurl tendency of the springs imparts a lift to the curled spring convolutions, and the shoes transmit the lift to the sash. The springs recurl into the convolutions as the shoes rise and uncurl from the shoes into the shoe channels when the shoes move downward, and neither movement requires the springs to slide frictionally within the shoe channels. Each shoe is preferably formed of two identical halves that are assembled to trap the curl spring along with a cam that locks the shoe when the sash tilts.

43 Claims, 7 Drawing Sheets

SASH SHOE SYSTEM FOR CURL SPRING WINDOW BALANCE

RELATED APPLICATIONS

This is a Division of application Ser. No. 08/040,457, filed 1 Apr. 1993, now U.S. Pat. No. 5,353,548, entitled CURL SPRING SHOE BASED BALANCE SYSTEM.

BACKGROUND

Constant force curl springs have been used in window balance systems where they have the advantage of applying a constant lifting force to counterbalance the constant weight of a window sash. The constant force of these springs is derived from the curling tendency of an uncurled length of a spring steel strip that has been formed to curl up. When the strips are uncurled and extended, each increment of the extended strip is biased to recurl itself and thus exerts a constant force against spring extension.

Curl springs have never been popular in window counterbalance systems, though, because each of their known arrangements have suffered from at least one competitive drawback. For example, sash mounted arrangements of curl springs have not allowed the sash to tilt; jamb mounted arrangements have taken up window space that manufacturers have been unwilling to commit to balance systems; and tilt sash arrangements have been inefficient and sometimes short-lived or inadequate in performance. The result is that only a few of the many different proposed arrangements of curl spring balance systems are presently marketed, and these have only a small market share.

SUMMARY OF THE INVENTION

An investigation of the way curl springs have been applied to counterbalance window sash has led to discovery of a new spring and shoe arrangement that accommodates a tilt sash and employs curl springs in a much more efficient manner. Curled up convolutions of the springs are carried by or contained within sash shoes that run in sash channels alongside a sash moving in sash runs. A connection between the shoes and the sash allows the sash to tilt, and the springs apply a constant counterbalance lifting force to the shoes, which transmit this lift to the sash. Free end regions of uncurled lengths of the springs are mounted within the shoe channels so that the springs curl up into the shoes as the shoes move upward in the shoe channels and uncurl from the shoes into the shoe channels as the shoes move downward in the shoe channels.

Such an arrangement has several important advantages that curl springs have not previously achieved in tilt sash counterbalance systems. One advantage is increased spring efficiency from reduced friction. Moving an uncurled length of spring along a shoe channel surface as the sash moves produces a surprising amount of friction which is eliminated by the inventive arrangement. A related advantage is quieter operation, by eliminating the noise of a spring sliding within a shoe channel as a sash moves. Other advantages include arrangement of the counterbalance devices to accommodate a full extent of sash travel, a normal configuration of jamb and shoe channel, and standard tilt latches mounted on the upper rail of a sash. The way the invention combines curl springs with sash shoes also results in simple and efficient shoe and installation parts that reduce manufacturing and installation costs.

DRAWINGS

DETAILED DESCRIPTION

Figure 1:
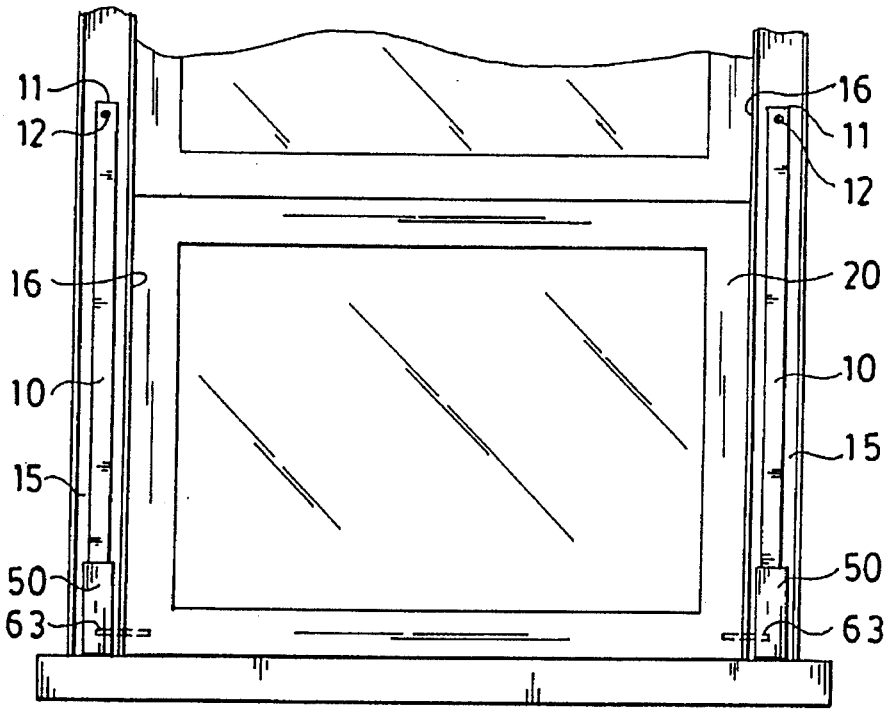
FIG. 1 is a partially schematic front view of a preferred embodiment of a curl spring balance system applied to a window sash.
Figure 2:
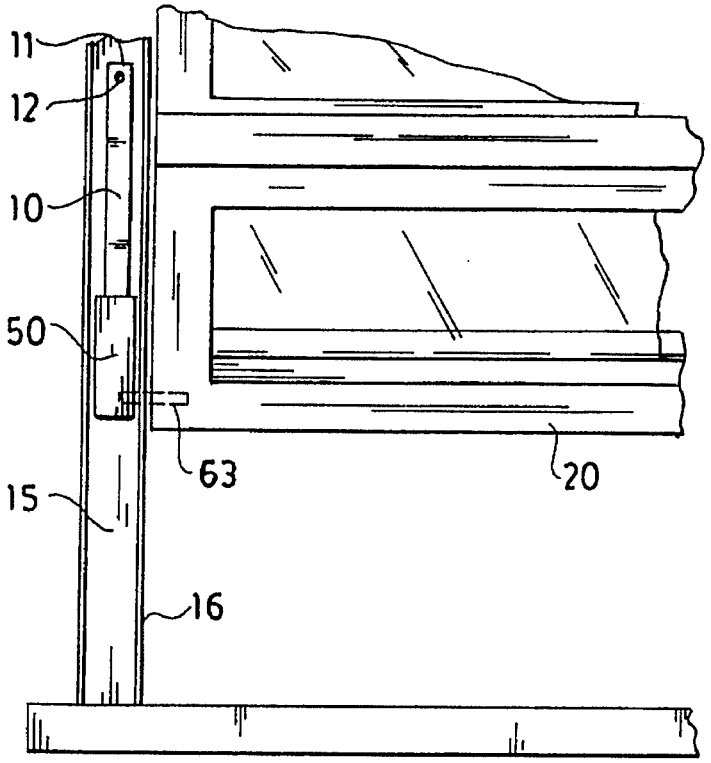
FIG. 2 is a fragmentary schematic front view of the balance system of FIG. 1 showing a raised and tilted sash.
Figure 3:
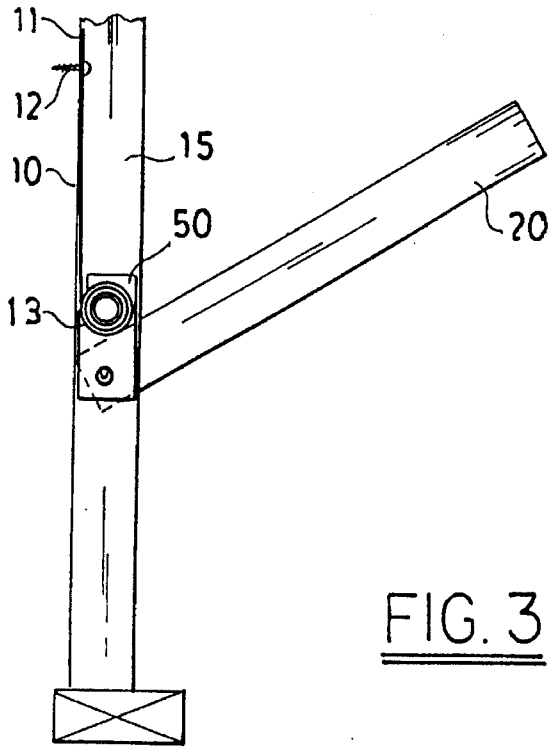
FIG. 3 is a partially schematic side view of the window of FIG. 2 showing the balance system cooperating with a tilted sash.
Figure 4:
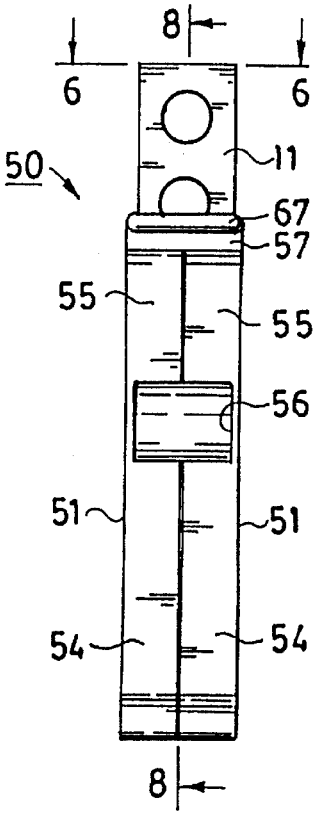
FIG. 4 is an edge view of a preferred embodiment of sash shoe for the inventive sash balance system.
Figure 5:
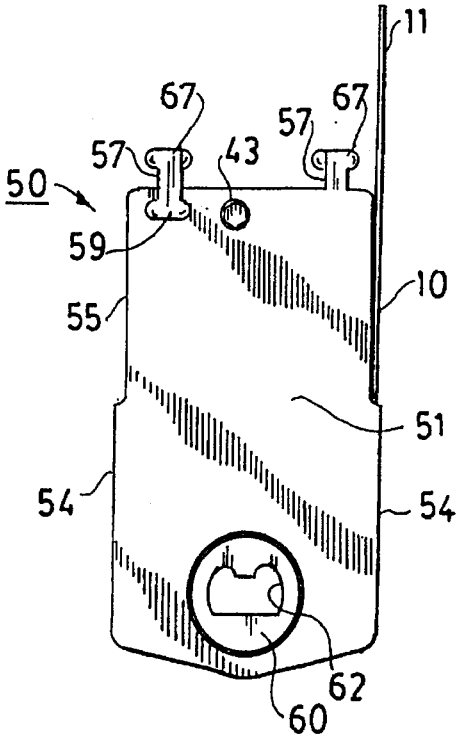
FIG. 5 is a side view of the sash shoe of FIG. 4.
Figure 6:
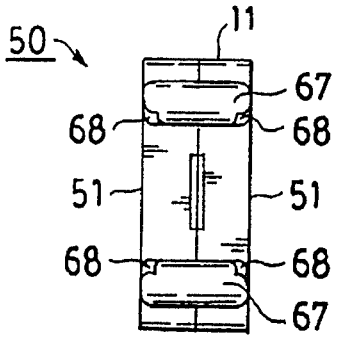
FIG. 6 is a top view of the sash shoe of FIGS. 4 and 5, taken along the line 6—6 of FIG 4.

FIGS. 1–3 schematically show a generally preferred arrangement for employing curl springs 10 within shoes 50 counterbalancing sash 20. Free end regions 11 of springs 10 are fixed in positions within shoe channels 15, as schematically indicated by fastener 12. Curled up convolutions 13 of springs 10 are contained within shoes 50, which move up and down in shoe channels 15 as sash 20 moves up and down in sash runs 16. Shoes 50 are interconnected with sash 20, preferably by means of pivot bars or pins 63, which allow sash 20 to tilt, as shown in FIG. 3. Shoes 50 preferably lock in shoe channels 15 when sash 20 tilts, but it is also possible to allow shoes 50 to rise in channels 15 from the upward bias of springs 10 when tilting of sash 20 removes some of the sash weight from shoes 50.

The curl spring counterbalance arrangement schematically shown in FIGS. 1–3 achieves the general advantages mentioned above. First, it nearly doubles spring efficiency by eliminating the friction of sliding an uncurled length of a curl spring against a shoe channel surface as a sash moves. Measurements of currently marketed balance systems using curl springs mounted in jamb shoe channels so that free end regions of the curl springs connect to sash shoes movable in the shoe channels show that only about 30 to 40 percent of the potential spring force is actually delivered to lift the sash. In contrast, the same measurements applied to the arrangement shown in FIGS. 1–3, with curled up spring convolutions 13 contained within movable sash shoes 50, show that 67 percent of the potential spring force was delivered to lift sash 20. The substantial efficiency improvement achieved by the illustrated arrangement comes from eliminating the friction of sliding an uncurled length of spring against the shoe channel surface. This frictional loss is surprisingly large because of the tendency of spring 10 to curl so that its uncurled length bends and presses against a fixed channel surface as the spring moves. In the inventive arrangement, the pressure of spring 10 against a wall of shoe channel 15 does not cause any frictional loss, because the uncurled length of spring 10 does not move relative to shoe channel 15. Instead, spring 10 rests flat and motionless against shoe channel wall 15 as spring 10 recurls into coiled convolutions 13 when shoes 50 and sash 20 rise and uncurls from shoes 50 into shoe channel 15 when shoes 50 and sash 20 move downward.

The more efficient employment of curl springs 10 in the balance system illustrated in FIGS. 1–3 allows larger lifting forces to be derived from curl springs of the same width and curl diameter so that sash lifting force can be increased within the size and shape limitations for the springs. Also, making the spring arrangement more efficient can be used to extend the spring cycle life. The coiling radius and spring thickness can result in a short cycle life if a spring filling the available space is designed for a maximum lifting force necessary to overcome excessive friction. When the friction is greatly reduced, making the spring employment more efficient, a spring fitting within the same space can be designed for a longer cycle life while still providing adequate lift.

The spring force of curl springs is generally proportional to spring width, and limits on the size and configuration of space within window jambs also limit the width that can be used for curl springs. These are usually constant force springs and are often referred to as constant force springs; but it is possible to vary the spring force along its length, by changing the width, the curling radius, or the temper of the spring steel. Some friction is unavoidably involved in the curling and uncurling of convolutions of the springs within a containment region, but this can be minimized by selection of low friction bearings or materials disposed in the spring coiling region.

Another advantage of the illustrated arrangement is elimination of the sliding noise of a metal spring rubbing along a shoe channel surface. Without this noise, sash operation is much quieter and gives a person moving the sash a sense of precision and refinement.

Containment of curled up spring convolutions 13 in shoes 50 also better accommodates the balance springs to the vertical travel desired for sash 20. Free end region 11 of spring 10 can be secured in shoe channel 15 above the uppermost limit of travel of shoes 50 with sash 20. This level can be above the upper rail of sash 20, as shown in FIG. 1; because a tilt latch, which is commonly arranged at the upper rail of a tilt sash but is not illustrated in the drawings, can move up and down over the mounting of free end region 11 without interference. When convolutions of curl springs 13 are mounted in shoe channel is, as suggested in the prior art, these interfere with a tilt latch at the top rail of sash 20 so that they have to be mounted below the lowermost travel of the top rail of sash 20. This then limits the upward movement of the sash shoes and limits the upward travel of sash 20. When two or more curl springs are ganged in tandem, this can limit the upward movement of sash 20 enough to impede a fire escape route through the window from the building.

Several other advantages and efficiencies derive from the illustrated employment of curl springs in a sash balance system. These involve shoe configurations, shoe locking mechanisms, mounts for the free ends of curl springs, and ganging curl springs in tandem, as shown in FIGS. 4–21 and explained below.

A preferred embodiment of lock shoe 50 is illustrated in FIGS. 4–11. Shoe 50 is formed of two identical parts or halves 51 so that any one of the parts 51 can join with any other part 51 to from a complete body for shoe 50. Each body part 51 is formed, to provide half of a containment region 53 for receiving the curled up convolutions 13 of spring 10. Each body part 51 also provides half of an opening 52 for a pin or pivot bar receiver 60. Opposite lower sides 54 of body parts 51 are parallel and separated by a suitable distance for a smooth sliding fit in shoe channel 15, and upper sides 55 of body parts 51 are separated by a smaller distance to allow a length of spring 10 to pass from containment region 53 in between one of the shoe side walls 55 and a wall of shoe channel 15. A pair of openings 56 ark formed between lower walls 54 and upper walls 55 to allow passage of an uncurled length of spring 10. This allows spring 10 to uncurl from either side of containment region 53, and it also allows body parts 51 to be made identical and have registered openings 56 when assembled together. Assembling shoe 50 from a pair of identical body parts 51 also gives shoe 50 identical front and rear faces so that the shoe can be installed with either face confronting sash 20.

Figure 7:
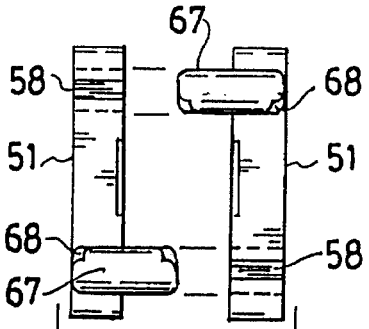
FIG. 7 is a top view of the sash shoe of FIG. 6 with shoe body parts separated and aligned for interconnection.
Figure 8:
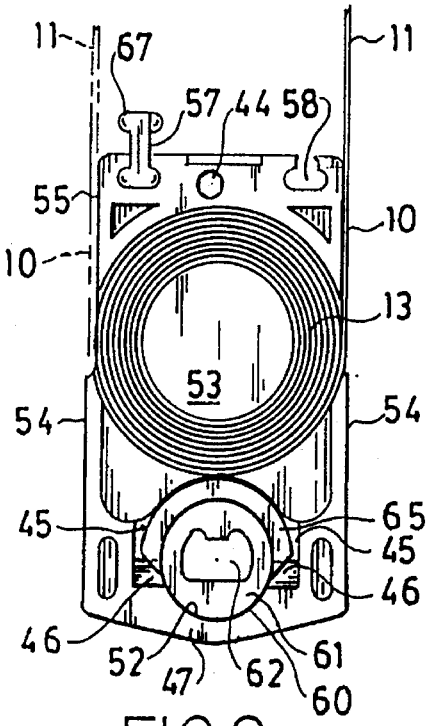
FIG. 8 is a side view of the sash shoe of FIG. 4, with one body half removed from along the line 8—8 thereof.
Figure 9:
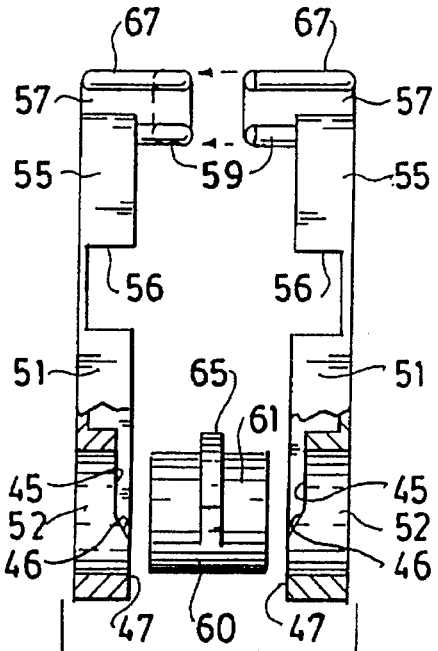
FIG. 9 is a partially cutaway side view of the sash shoe of FIG. 7 with separated body parts aligned for closing together on a pin receiver and locking cam.
Figure 10:
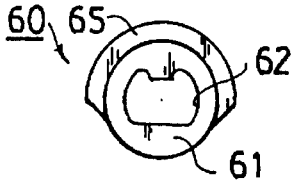
FIG. 10 is a front view of a preferred embodiment of pin receiver and locking cam for the inventive sash shoe.
Figure 11:
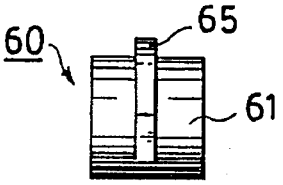
FIG. 11 is side view of the receiver and locking cam of FIG. 10.

A projection 57 and a recess 58 are formed at the top of each body part 51 so that the downward facing portion 59 of each projection 57 can be slid into recess 58 of a confronting body part as shown in FIG. 8. When body parts 51 are then pressed together, as shown in FIGS. 7 and 9, the downward facing portions of projections 59 have interference fits in slots 58 and thus hold body parts 51 in the assembled relation of FIGS. 4 and 6. Before this is done, curled spring convolutions 13 are placed in containment region 53 so that spring 10 extends out of an opening 56, and receiver 60 is positioned in opening 52 between the body parts. This makes the assembly of shoe 50 simple and inexpensive because it is accomplished by positioning a spring 10 and a receiver 60 in one body part and then simply pressing another body part into a confronting position that is held securely by the interference fit between projections 59 and slots 58.

Receiver 60 has a preferably cylindrical body 61 with a through opening 62 that receives a pin or pivot bar 63 connected to sash 20. Receiver 60 thus participates in a connection between shoe 50 and sash 20, and many variations of such a connection are possible. A platform or other support can extend from shoe 50 to sash 20, for example. Window jambs normally include a slot between a sash run 16 and a shoe channel 15 allowing a connector such as pin 63 to extend between shoe 50 and sash 20.

Figure 12:
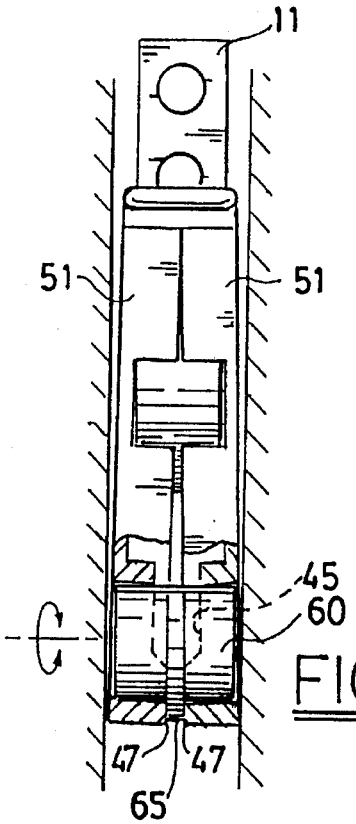
FIG. 12 is a partially cutaway schematic edge view of a preferred embodiment of sash shoe locked in a shoe channel by means of a shoe locking cam.

Receiver 60 preferably includes a cam 65 formed as an annular sector extending part way around cylindrical body 61. Cam 65 fits within a recess 45 in each of the body parts 51, and inclined cam follower surfaces 46 connect recess 45 with a confronting face surface 47 of each body part 51. When cam surface 65 is positioned in recess 45, in the neutral or sash vertical position for receiver 60, confronting surfaces 47 of body parts 51 are closed or engaged. When sash 20 tilts, receiver 60 is turned or pivoted within shoe 50, which makes cam 65 ride up one of the inclined surfaces 46 onto face surface 47. This spreads body parts 51 apart by the thickness of cam 65. It also allows cam 65 to pivot in either direction to accomplish the cammed separation of body parts 51, as shown in FIG. 12. This thickens or widens shoe 50 by increasing the separation between its front and back surfaces so that shoe 50 locks in shoe channel 15 when sash 20 tilts. The amount of shoe widening is determined by the thickness of cam 65, which can be varied to meet different shoe locking requirements. The top of shoe 50, which is held together by projections 59 in recesses 58, remains tightly assembled, and shoe body parts 51 flex to allow the cammed separation of their lower regions when the shoe locks. This provides not only a simple locking arrangement for a sash shoe, but it also provides more locking force from the torque applied by sash tilting than is achieved with other shoe locking mechanisms that operate by spreading apart portions of a shoe. The spreading of shoe 50 occurs in a direction parallel with sash 20, which extends across the narrower of the generally rectangular dimensions of shoe channel 15; and this may account for the improved locking force provided by cam 65 disposed between face surfaces 47.

Figure 13:
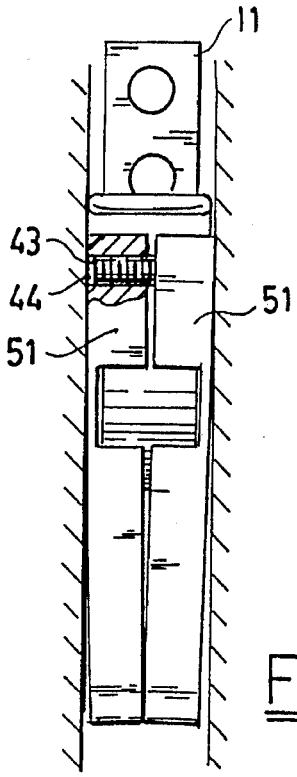
FIG. 13 is a partially cutaway schematic edge view showing shoe body parts adjustably separated for shoe friction purposes.

Shoe 50 can also be provided with adjustable friction, although there is less need for friction adjustment in curl spring balance systems because of the normally constant force of the curl springs. If the spring lift is a little excessive, though, or if the upper sash has a tendency to drop from an uppermost position, the frictional fit of shoe 50 in shoe channel 15 can be increased. This is preferably done by means of an opening 44 formed eccentrically into an upper region of body parts 51 so that openings 44 in a pair of assembled body parts do not register with each other. Then, a screw 43 can be threaded into an opening 44 in one of the body parts 51, and its leading end will engage a confronting surface of the mating body part. Further turning of the screw will urge the upper regions of body parts 51 apart, as shown in FIG. 13, to thicken shoe 50 enough to increase its frictional resistance to movement in channel 15.

Figure 14:
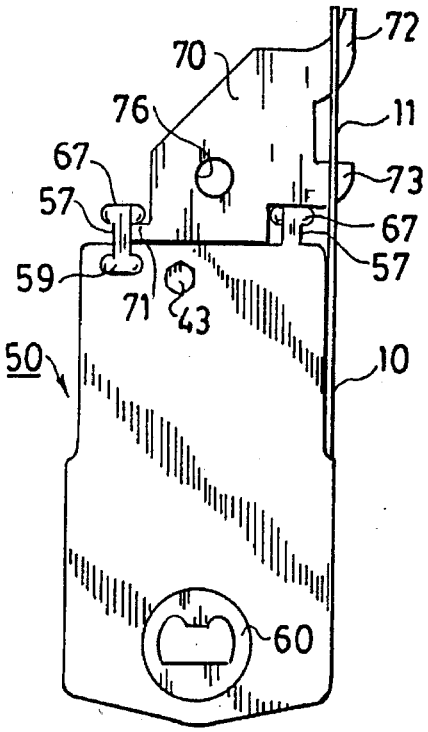
FIG. 14 is a side view of a preferred embodiment of sash shoe combined with a mount for a curl spring.
Figure 15:
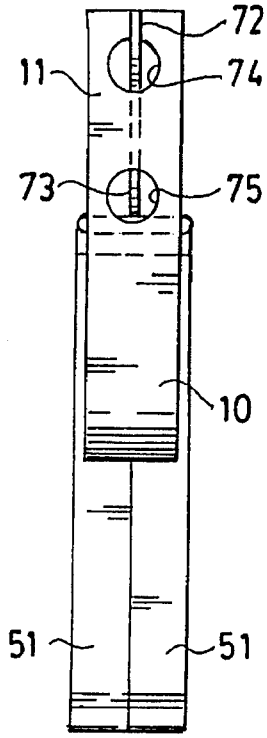
FIG. 15 is a spring side edge view of the shoe of FIG. 14.
Figure 16:
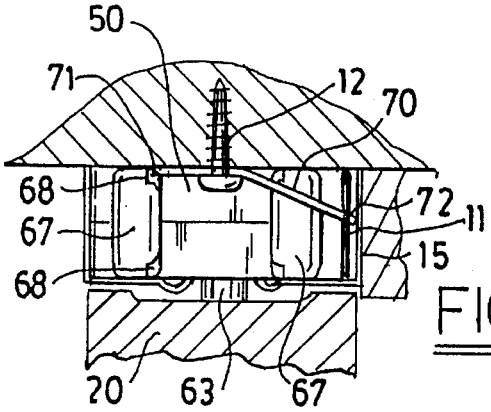
FIG. 16 is a partially schematic top view of a preferred mount of a curl spring in a shoe channel.
Figure 17:
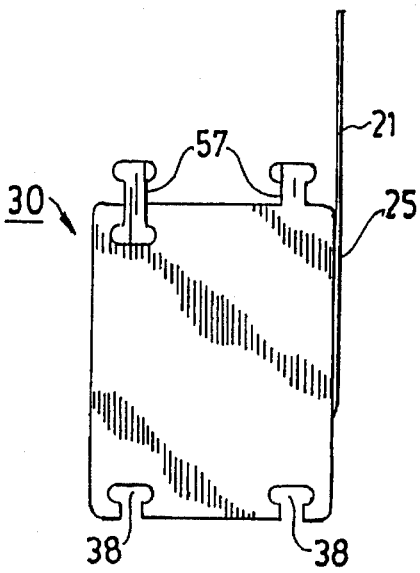
FIG. 17 is a side view of a preferred embodiment of a companion carrier for a companion curl spring usable in the inventive balance system.
Figure 18:
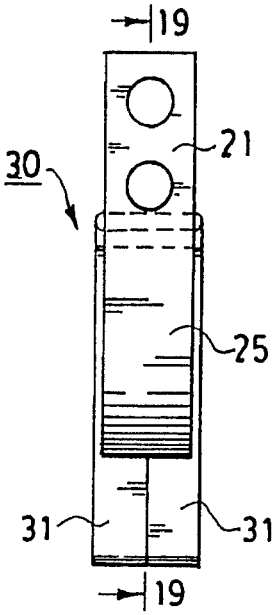
FIG. 18 is a spring side edge view of the companion carrier of FIG. 17.
Figure 19:
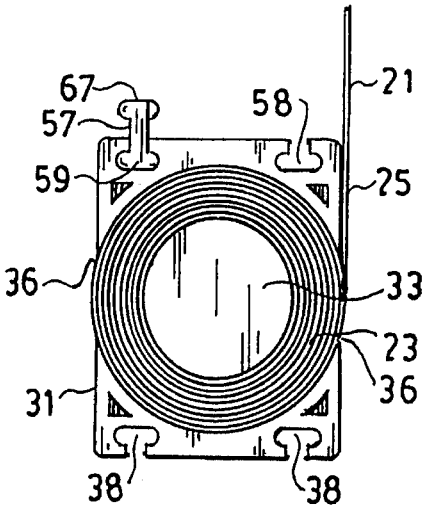
FIG. 19 is a side view of the companion carrier of FIG. 18, with a body half removed from along the line 19—19 thereof.
Figure 20:
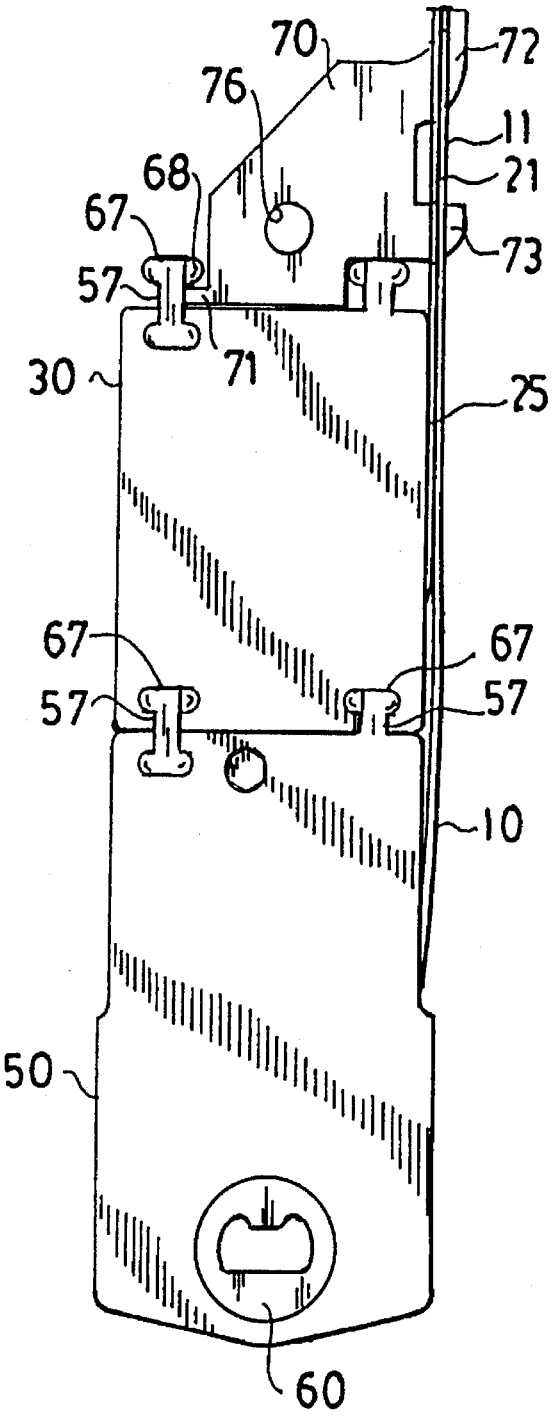
FIG. 20 is a side view of a preferred embodiment of shoe and companion carrier assembled with springs and a mount.
Figure 21:
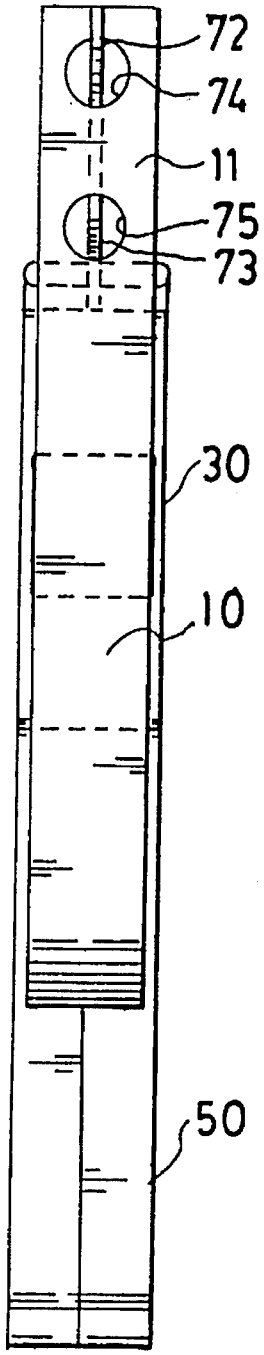
FIG. 21 is an edge view of the assembly of FIG. 20.

The inventive employment of curl springs 10 in sash shoes 50 affords not only a simple and efficient sash shoe, but a simple and efficient way of combining a spring mount and a sash shoe, as shown in FIGS. 14–16. Some sort of fastener or mount is preferred for fastening free end region 11 of spring 10 in shoe channel 15, and the invention provides such a mount 70 arranged to cooperate with spring 10 and shoe 50 to form a secure subassembly that simplifies the installation of the spring and shoe.

First, projections 57 are formed to extend upward from the top of shoe 50 to serve at least two purposes. One of these purposes is to engage and hold mount 70 on top of shoe 50 in an engagement with free end region 11 of spring 10, as shown in FIG. 14. The upward facing regions of projections 57 have dovetailed or enlarged heads 67, and mount 70 has an end projection 71 that hooks under one of the projections 67 while the opposite end of mount 70 has a hook 72 and a guide 73 that engage respective openings 74 and 75 in free end region 11 of spring 10. Hook 72 holds spring 10 against any downward movement, and guide 73 keeps mount 70 oriented upright in alignment with the lineal direction of spring 10. In such a position, mount 70 rests on one of the heads 67 of the projections 57, hooks under the other head 67 of the other projection 57, and engages the free end region 11 of spring 10. The recoil tendency of spring 10 pulls mount 70 downward against the top of shoe 50 in the position shown in FIG. 14, and the engagement of hook 72 and guide 73 with openings 74 and 75 in spring 10 keeps mount 70 from tilting or escaping from the illustrated position. This reliably holds mount 70 on top of shoe 50 in a preliminary subassembly that is ready for installation, with mount 70 hooked into the free end region 11 of spring 10. The illustrated subassembly keeps mount 70 from being separated or lost and avoids the problems otherwise involved in assembling and organizing several independent components at the moment of installation.

The invention also allows mount 70 to release automatically from its preassembly position on top of shoe 50, when mount 70 is secured within shoe channel 15 by a fastener 12, as illustrated in FIG. 16. The upward facing heads 67 of projections 57 are formed with mount release slots 68 that release projection 71 from its trapped position under one of the heads 67, when fastener 12 is driven through hole 76 in mount 70 and into a wall of shoe channel 15. As mount 70 is pressed against the shoe channel wall in the region of fastener 12, its projection 71 is moved to a face region of shoe 50 where one of the release slots 68 allows projection 71 to escape from its hooked position under projection head 67.

The fastening of mount 70 in place in shoe channel 15 also bends mount 70 between the region of fastener hole 76 and hook 72, which remains engaged with opening 74 in the free end region 11 of spring 10. This does not impair the ability of mount 70 to hold spring 10 securely in place in a mounted position in shoe channel 15, though.

The arrangement of mount 70 releasably on the top of shoe 50 has several advantages. It not only forms a preassembly package of spring 10, shoe 50, and mount 70 that can be shipped as a subassembly to a Window manufacturer, but it positions these components so that installation involves only positioning shoe 50 to dispose mount 70 at the proper elevation in shoe channel 15 and then driving fastener or screw 12 through hole 76. As screw 12 forces mount 70 against a wall of shoe channel 15, mount 70 automatically releases from its preassembly position on top of shoe 50. This happens without loss of engagement between mount 70 and the free end region 11 of spring 10 so that spring 10 is properly mounted in the shoe channel by the simple act of driving a fastener through hole 76 in mount 70. The preferred preassembly arrangement of shoe 50, spring 10, and mount 70 also allows installation of shoe 50 in either of its two possible orientations in shoe channel 15. This means that any shoe can function on the right or left sides of a sash, and any shoe can be mounted to position spring 10 on the preferred side of shoe channel 15. This is normally on the inside surface of shoe channel 15, where spring 10 is not visible to a person operating sash 20 from inside a building.

The installed arrangement of the preferred embodiment of shoe 50 disposes the curled convolutions 13 of spring 10 on an axis parallel with sash 20 and its tilt axis on pins 63. It is also possible to turn the axis of curled convolutions 13 by 90 degrees, providing shoe channel 15 can be made deep enough to accommodate such a spring orientation. This can occur in large "architectural" windows having window jambs of considerable depth. If such an orientation of springs 10 is used, a different form of mount would be desirable.

It is also possible to mount a spring 10 so that a fixed end region attached to the window jamb is allowed to curl at the same time that a movable and region curls up within the shoe. For this, an arrangement would be required to ensure that neither end of spring 10 can escape from either the shoe or the jamb. A possible advantage is lengthening the curl spring while minimizing the space required for curled up convolutions.

The invention also facilitates ganging the springs in tandem. This involves forming a sash shoe with more than one containment region for the curled convolutions 13 of curl springs 10; and from among the several ways this can be done, a preferred way is illustrated in FIGS. 17–21. A companion curl spring 25 having curled up spring convolutions 23 and a free end region 21 is arranged in a containment region 33 of a companion carrier 30 that can be interconnected to an upper region of shoe 50, as illustrated. Using companion carrier 30 allows additional curl spring 25 to be added to spring 10 in shoe 50, whenever the additional lifting force of an extra spring is required, without forming a sometimes unnecessary additional spring containment region within shoe 50 itself. The projections 57, with their heads 67, extending above the top of shoe 50 as previously described, serve as interconnectors for companion carrier 30, which has recesses 38 formed in its bottom region to provide a sliding interlock fit with projections 57.

Like the body of shoe 50, the body of companion or piggyback carrier 30 is preferably formed of two identical parts 31. The upper region of each part 31 is formed with the same projection 57 and recess 58 as is formed on the top region of shoe body part 51. The halves 31 of companion carrier 30 confront and slide together in an interlocked fit of projections 59 in recesses 58 in thee same way as described for the locking together of shoe body parts 51. Openings 36 are formed on each side of containment region 33 so that companion spring 25 can extend through either opening 36 in the same way that spring 10 extends through either opening 56 of shoe 50.

When companion case 30 is desired for increasing the lifting force by adding companion spring 25, then mount 70 has its hook 72 and guide 73 interconnected with openings 74 and 75 formed in free end regions 21 and 11 of the combined springs so that mount 70 can be preassembled with the springs on top of companion case 30 in the same way that mount 70 can be preassembled on the top of shoe 50. This is made possible by the presence of projections 57 with their enlarged heads 67 formed on the top of companion carrier 30 in the same way they are formed on the top of shoe 50. Projections 57 also enable two or more companion carriers 30 to be piggybacked or stacked on top of shoe 50 so that three, four, or more springs can provide a combined lift. This may require elevating the mounting position of the free end regions of the multiple springs; but since the preferred spring mount 70 does not interfere with sash movement, this becomes possible by using suitable lengths for the springs involved.

The embodiments of FIGS. 4–21 all involve cavity mounts for the curled up convolutions of a curl spring, and all arrange at least one cavity for a curl spring within the sash shoe. It is also possible for the curl spring mount to be arranged outboard of a sash shoe and for curled up convolutions of a curl spring to be mounted on a hub or bushing, instead of confined within a cavity. Several of these possibilities are schematically illustrated in FIGS. 22–25.

Figure 22:
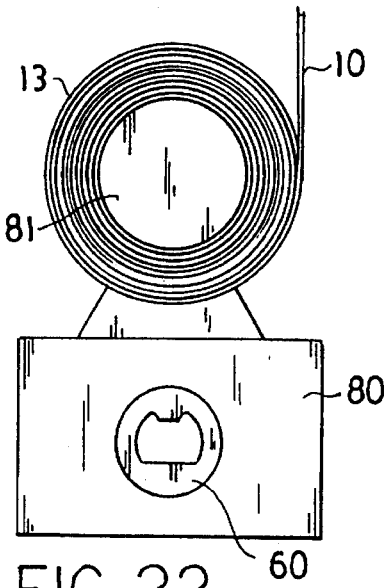
FIG. 22 is a partially schematic, elevational view of an alternative mount for a curl spring carried by a sash shoe.

The sash shoe 80 of FIG. 22 includes a receiver 60 affording a connection with a sash and is configured for running in a shoe channel. It also carries the curled up convolutions 13 of curl spring 10, but does so in an outboard mount, rather than an inboard mount. This is formed by hub 81 arranged above shoe 80 to hold curled up convolutions 13. Hub 81 can be fixed to shoe 80 or removably attached to shoe 80 and can also be arranged within a cavity provided within a sash shoe. Curl spring 10 curls up onto hub 81 and uncurls from hub 81 as shoe 80 moves up and down.

Figure 23:
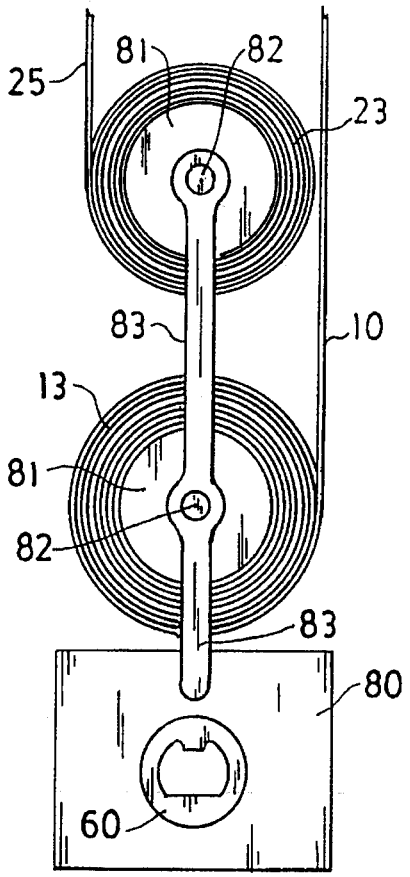
FIG. 23 is a partially schematic, elevational view of alternative mounts for a pair of curl springs carried by a sash shoe.

For further reduction of the friction of curling and uncurling spring 10, hub 81 can be mounted to rotate on a journal or bearing 82, as schematically shown in FIG. 23. Bearing 82, rotationally supporting hub 81, is connected to shoe 80 by a link 83 that can be either fixed or removable. A rotatable hub 81 can also be arranged within a sash shoe.

A tandem outboard mount of curl springs is also possible, as shown in FIG. 23. A companion hub 81 supporting curled convolutions 23 of a companion curl spring 25 can be added to shoe 80 by extending link 83 to a companion bearing 82. Springs 10 and 25 are shown extending upward above opposite sides of shoe 80, to illustrate this possibility.

Figure 24:
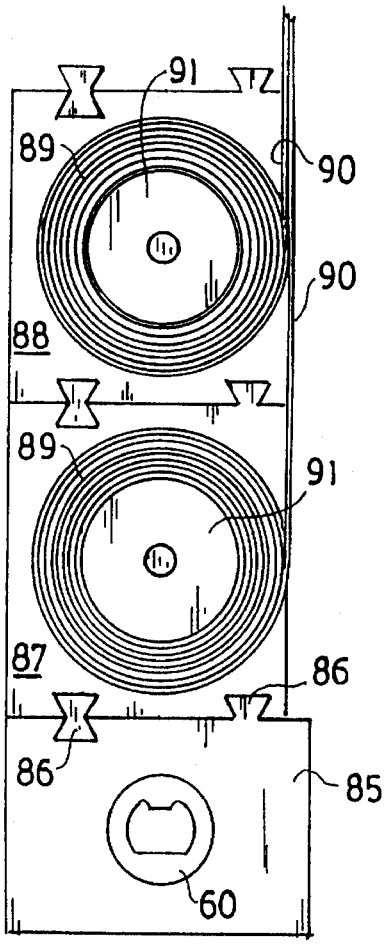
FIG. 24 is a partially schematic, elevational view of a sash shoe having separable curl spring carriers.

Another shoe 85, as shown in FIG. 24, has one or a plurality of curl springs detachably connected to the body of shoe 85. Dovetails 86 are arranged in a manner similar to the arrangement of projections 57 so that curl spring containers 87 and 88 can be mounted as desired on top of shoe 85. Although the curled up convolutions 89 of curl springs 90 are contained within carriers 87 and 88, they can be mounted on rotatable hubs 91, instead of being cavity mounted.

Figure 25:
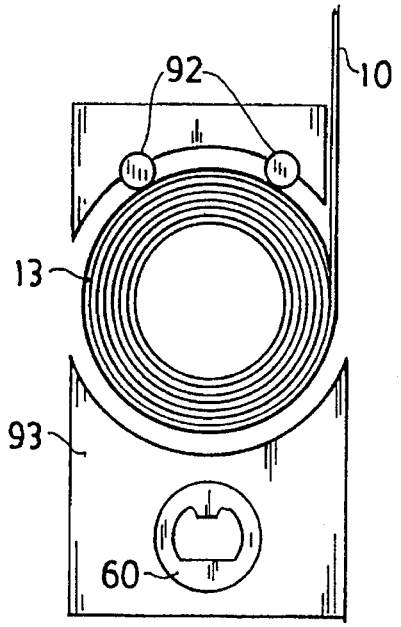
FIG. 25 is a partially schematic, elevational view of an alternative shoe cavity mount for a curl spring.

A cavity mount can reduce the friction of curling and uncurling a spring by providing friction bearings 92, as shown in FIG. 25. These can engage the outermost of the curled convolutions 13 of spring 10 in shoe 93.

The alternatives shown in FIGS. 22–25 are independently combinable with features of the embodiments of FIGS. 4–21. Instead of representing distinct species, the features shown in FIGS. 22–25 illustrate alternatives that can be combined in many specifically different ways.

I claim:

1. A sash shoe configured for running in a shoe channel of a window jamb to transmit counterbalance lifting force to a sash, the sash shoe comprising:

a. a shoe body retaining a curled length of a curl spring having an uncurled length extending above the body; and b. a free end region of the uncurled length of the curl spring being connected to a mount that is releasably retained on an upper region of the shoe body until the mount is fastened to a mounting surface.

2. The sash shoe of claim 1 wherein retention of the mount on the body automatically releases when the mount is fastened to the mounting surface.

3. The sash shoe of claim 1 wherein a configuration of the upper region of the shoe body for releasably retaining the mount can alternatively retain a carrier of a companion curl spring.

4. The sash shoe of claim 3 wherein an upper region of the carrier is configured for releasably retaining the mount.

5. The sash shoe of claim 1 wherein the mount engages a pair of openings in the free end region of the curl spring and engages an undercut projection at the upper region of the shoe.

6. The sash shoe of claim 1 wherein the shoe body includes a sash pin receiver that is accessible from either of a pair of opposite sides of the shoe body so that the mounting orientation of the shoe body is reversible.

7. The sash shoe of claim 6 wherein the retention of the mount on the body automatically releases when the mount is fastened to the mounting surface in either reversible orientation of the shoe body.

8. A sash shoe for engaging a sash and moving with the sash so that the shoe transmits to thee sash an upwardly biased counterbalance lifting force, the sash shoe comprising:

a. the shoe holding a sash connection and curled convolutions of a curl spring arranged so that an uncurled length of the curl spring can extend upward from the shoe;

b. a companion carrier retaining a companion curl spring arranged so that an uncurled length of the companion curl spring can extend upward from the companion carrier; and c. the curl spring and the companion curl spring being fastened above the companion carrier so that the curling tendencies of the springs tending to curl up any uncurled lengths of the spring are combined to provide the lifting force for the shoe.

9. The sash shoe of claim 8 including a mount connected to free end regions of the springs and releasably retained on an upper region of the companion carrier.

10. The sash shoe of claim 8 wherein the sash connection includes a sash pin receiver arranged below the curl spring.

11. The sash shoe of claim 8 wherein a region of the shoe below the curl spring is wider than a region of the shoe adjacent an uncurled length of the curl spring.

12. The sash shoe of claim 8 wherein the companion carrier is attachable to an upper region of a shoe body.

13. A sash shoe comprising:

a. two identical shoe body parts configured to interconnect;

b. a sash pin receiver trapped between the interconnected body parts; and c. a cam formed on the sash pin receiver and cam follower surfaces formed on the interconnected shoe body parts so that turning the sash pin receiver cams the shoe body parts apart, for locking the shoe in a shoe channel.

14. The sash shoe of claim 13 including a containment region between the interlocked body parts arranged for receiving a curled up length of a curl spring and allowing an uncurled length of the curl spring to extend above the shoe.

15. The sash shoe of claim 14 wherein a surface of the containment region bears against an upwardly facing region of the curled length of the spring.

16. The sash shoe of claim 13 wherein the pin receiver is accessible from either of a pair of opposite sides of the shoe so that the shoe can operate in either of two orientations relative to a sash.

17. The sash shoe of claim 16 including a containment region between the interlocked body parts formed with a pair of access openings so that a curled length of a curl spring can be held in the containment regions and an uncurled length of the curl spring can extend through either access opening to a region above the shoe.

18. The sash shoe of claim 13 wherein shoe body parts include holes that do not align when the shoe body parts are interconnected, and a screw is threaded into one of the holes in one of the shoe body parts to bear against the other shoe body part and adjust a separation of the shoe body parts for adjusting a frictional fit of the shoe body within a shoe channel.

19. The sash shoe of claim 15 including a containment region between the interlocked body parts arranged for receiving a curled up length of a curl spring and allowing an uncurled length of the curl spring to extend above the shoe and including a free end region of the uncurled length of the curl spring being connected to a mount that is releasably retained on an upper region of the shoe body until the mount is fastened to a mounting surface.

20. The sash shoe of claim 13 wherein the body parts interconnect in one end region and are cammed apart at an opposite end region.

21. The sash shoe of claim 20 including a containment region adjacent the one end and arranged for receiving a curled up length of a curl spring and allowing an uncurled length of the curl spring to extend above the shoe.

22. A sash shoe comprising:

a. a shoe body mountable in either of two opposite orientations on either side of a tilt sash;

b. the shoe body being formed of a pair of identical parts that are interconnected so that either of two opposite faces of the shoe body can be disposed to confront the sash;

c. a pin receiver trapped between the body parts and having openings on opposite sides so that a sash pin can enter the receiver from either opposite face of the Shoe body; and d. cam and follower surfaces being arranged between the receiver and the shoe body parts so that turning the receiver in either direction from a neutral position cams apart the shoe body parts to spread apart the opposite faces of the shoe body.

23. The sash shoe of claim 22 Wherein the interconnected shoe body parts define a containment region arranged to receive curled convolutions of a curl spring extendable above the shoe body for upwardly biasing the shoe.

24. The sash shoe of claim 23 formed to provide a pair of opposite access openings to the containment region so that curled convolutions of a curl spring can be oriented to extend an uncurled length of the curl spring upward from the shoe through either of the access openings.

25. The sash shoe of claim 22 wherein a free end region of the curl spring is connected to a mount that is releasably retained on an upper region of the shoe.

26. The sash shoe of claim 25 wherein the releasable retention of the mount on the shoe automatically releases when the mount is fastened to a mounting surface.

27. The sash shoe of claim 26 wherein the mount engages a pair of openings in the free end region of the curl spring and engages an undercut projection on the upper region of the shoe.

28. The sash shoe of claim 22 wherein each of the shoe body parts has a screw hole, and a screw is threaded into one of the holes in one of the shoe body parts to engage the other shoe body part for adjustably separating the shoe body parts.

29. The sash shoe of claim 22 wherein the body parts interconnect in one end region and are spread apart in an opposite end region.

30. The sash shoe of claim 29 wherein the interconnected shoe body parts define a containment region proximate to the one end and arranged to receive curled convolutions of a curl spring extendable above the shoe body for upwardly biasing the shoe.

31. A sash shoe comprising:

a. a shoe body having a receiver for a sash pin that is pivotable on a sash tilt axis;

b. at least one curl spring retained by the shoe so that a length of the curl spring uncurls from and extends above the shoe;

c. the axis of the curled convolutions of the curl spring being parallel with the tilt axis; and d. a recurl tendency of the curl spring exerting a lift on the sash pin receiver.

32. The sash shoe of claim 31 wherein the sash pin receiver is below the curl spring.

33. The sash shoe of claim 31 wherein the sash pin receiver is pivotable within the shoe, and a shoe locking device is actuated by pivoting the sash pin receiver.

34. The sash shoe of claim 31 wherein said at least one curl spring retained by the shoe comprises a plurality of curl springs having uncurled lengths extending above the shoe.

35. A sash shoe configured for running in a shoe channel of a window jamb to transmit counterbalance lifting force to a sash, the sash shoe comprising:

a. a shoe body having a curled length of at least one curl spring having an uncurled length extending above the shoe so that a recurl tendency of the curl spring biases the shoe upward; and b. the shoe body having a sash pin receiver that is pivotable relative to the shoe on a sash tilt axis parallel with an axis of curled convolutions of the curl spring.

36. The sash shoe of claim 35 wherein said at least one curl spring comprises a plurality of curl springs having curled convolutions on parallel axes.

37. The sash shoe of claim 35 wherein the sash pin receiver is below the said at least one curl spring.

38. The sash shoe of claim 35 including a shoe locking device actuated by pivoting the sash pin receiver.

39. A sash shoe for engaging a sash and moving with the sash so that the shoe transmits to the sash an upwardly biased counterbalance lifting force, the sash shoe comprising:

a. a shoe body having a plurality of curl springs having curled convolutions retained by the shoe and having uncurled lengths extending upward from the shoe; and b. the uncurled lengths of the curl springs being fastened above the shoe so that the curling tendencies of the springs tending to curl up any uncurled lengths of the springs are combined to provide the lifting force for the shoe.

40. The sash shoe of claim 39 including a receiver for a sash pin that is pivotable on a sash tilt axis.

41. The sash shoe of claim 40 wherein the sash pin receiver is pivotable relative to the shoe and including a shoe locking device actuated by pivoting the sash pin receiver.

42. The sash shoe of claim 40 wherein the axes of the curled convolutions of the curl springs are parallel with the tilt axis.

43. The sash shoe of claim 39 wherein the shoe has a sash pin receiver below the curl springs.

* * * * *

US005463793B1

REEXAMINATION CERTIFICATE (3274th)

United States Patent [19]

Westfall

[11] B1 5,463,793

[45] Certificate Issued Jul. 15, 1997

[54] SASH SHOE SYSTEM FOR CURL SPRING WINDOW BALANCE

[75] Inventor: Norman R. Westfall, Rochester, N.Y.

[73] Assignee: Caldwell Manufacturing Company, Rochester, N.Y.

Reexamination Request:
No. 90/004,310, Jul. 17, 1996

Reexamination Certificate for:

| | |
|---|---|
| Patent No.: | **5,463,793** |
| Issued: | **Nov. 7, 1995** |
| Appl. No.: | **280,491** |
| Filed: | **Jul. 26, 1994** |

Related U.S. Application Data

[62] Division of Ser. No. 40,457, Apr. 1, 1993, Pat. No. 5,353,548.

[51] Int. Cl.[6] ..... E05F 1/08; E05D 13/00

[52] U.S. Cl. ..... 16/197

[58] Field of Search ..... 16/193, 197, 93 R, 16/DIG. 16, 76; 49/445, 446, 181, 176

[56] References Cited

U.S. PATENT DOCUMENTS

| | | | |
|---|---|---|---|
| 2,609,193 | 9/1952 | Foster . | |
| 2,684,499 | 7/1954 | Lewis . | |
| 3,478,384 | 11/1969 | Skolnik | 16/197 |
| 4,227,345 | 10/1980 | Durham, Jr. . | |
| 4,363,190 | 12/1982 | Anderson . | |
| 5,152,032 | 10/1992 | Davis et al. | 16/197 |
| 5,157,808 | 10/1992 | Sterner, Jr. . | |
| 5,377,384 | 1/1995 | Riegelman | 16/193 |

*Primary Examiner*—Chuck Y. Mah

[57] ABSTRACT

A window balance system for a tilt sash uses a pair of constant force curl springs having curled convolutions carried by sash shoes and free end regions mounted in sash shoe channels above the region of travel of the shoes. The recurl tendency of the springs imparts a lift to the curled spring convolutions, and the shoes transmit the lift to the sash. The springs recurl into the convolutions as the shoes rise and uncurl from the shoes into the shoe channels when the shoes move downward, and neither movement requires the springs to slide frictionally within the shoe channels. Each shoe is preferably formed of two identical halves that are assembled to trap the curl spring along with a cam that locks the shoe when the sash tilts.

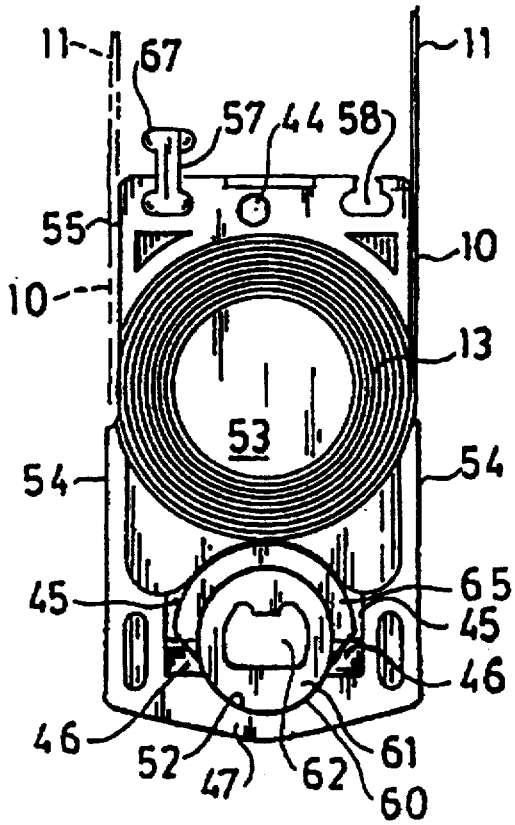

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–7, and 13–38 is confirmed.

Claims 10 and 43 are cancelled.

Claims 8, 39 and 40 are determined to be patentable as amended.

Claims 9, 11, 12, 41, and 42, dependent on an amended claim, are determined to be patentable.

8. A sash shoe for engaging a sash and moving with the sash so that the shoe transmits to [thee] *the* sash an upwardly biased counterbalance lifting force; the sash shoe comprising:

a. the shoe holding a sash [connection] *pin receiver* and curled convolutions of a curl spring arranged so that an uncurled length of the curl spring can extend upward from the shoe;

b. a companion carrier retaining a companion curl spring arranged so that an uncurled length of the companion curl spring can extend upward from the companion carrier; [and]

c. the curl spring and the companion curl spring being fastened above the companion carrier so that the curling tendencies of the springs tending to curl up any uncurled lengths of the spring are combined to provide the lifting force for the shoe[.]*; and* d. *the sash pin receiver being arranged below the curl spring.*

39. A sash shoe for engaging a sash and moving with the sash so that the shoe transmits to the sash an upwardly biased counterbalance lifting force, the sash shoe comprising:

a. a shoe body having a plurality of curl springs having curled convolutions retained by the shoe and having uncurled lengths extending upward from the shoe; [and]

b. the uncurled lengths of the curl springs being fastened above the shoe so that the curling tendencies of the springs tending to curl up any uncurled lengths of the springs are combined to provide the lifting force for the shoe[.]*; and* c. *the shoe having a sash pin receiver arranged below the curl springs.*

40. The sash shoe of claim 39 [including a] *wherein the* receiver *is* for a sash pin that is pivotable on a sash tilt axis.

* * * * *

US005463793C2

(12) EX PARTE REEXAMINATION CERTIFICATE (5489th)

United States Patent

Westfall

(10) Number: US 5,463,793 C2

(45) Certificate Issued: Aug. 29, 2006

(54) SASH SHOE SYSTEM FOR CURL SPRING WINDOW BALANCE

(75) Inventor: Norman R. Westfall, Rochester, NY (US)

(73) Assignee: Caldwell Manufacturing Company, Rochester, NY (US)

Reexamination Request:
No. 90/007,198, Sep. 10, 2004

Reexamination Certificate for:

| | |
|---|---|
| Patent No.: | **5,463,793** |
| Issued: | **Nov. 7, 1995** |
| Appl. No.: | **08/280,491** |
| Filed: | **Jul. 26, 1994** |

Reexamination Certificate B1 5,463,793 issued Jul. 15, 1997

Related U.S. Application Data

(62) Division of application No. 08/040,457, filed on Apr. 1, 1993, now Pat. No. 5,353,548.

(51) Int. Cl.
*E05F 1/08* (2006.01)
*B05D 13/00* (2006.01)

(52) U.S. Cl. ..... 16/197

(58) Field of Classification Search ..... None
See application file for complete search history.

(56) References Cited

U.S. PATENT DOCUMENTS

| | | | | |
|---|---|---|---|---|
| 2,734,235 | A | 2/1956 | Trammell, Jr. | 20/52.2 |
| 4,958,462 | A | 9/1990 | Cross | 49/181 |

FOREIGN PATENT DOCUMENTS

| | | |
|---|---|---|
| GB | 723056 | 2/1955 |

*Primary Examiner*—Matthew C. Graham

(57) ABSTRACT

A window balance system for a tilt sash uses a pair of constant force curl springs having curled convolutions carried by sash shoes and free end regions mounted in sash shoe channels above the region of travel of the shoes. The recurl tendency of the springs imparts a lift to the curled spring convolutions, and the shoes transmit the lift to the sash. The springs recurl into the convolutions as the shoes rise and uncurl from the shoes into the shoe channels when the shoes move downward, and neither movement requires the springs to slide frictionally within the shoe channels. Each shoe is preferably formed of two identical halves that are assembled to trap the curl spring along with a cam that locks the shoe when the sash tilts.

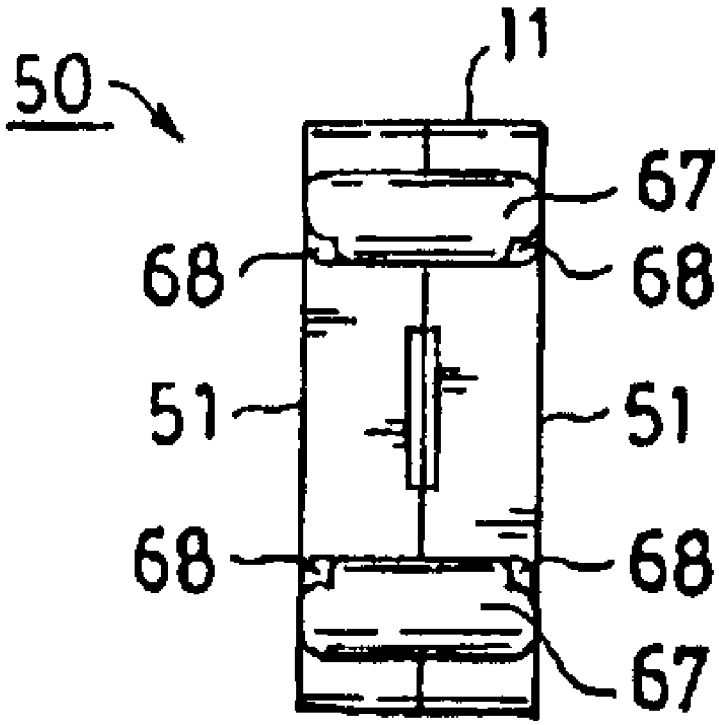

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–9 and 11–42 is confirmed.

Claims 10 and 43 were previously cancelled.

* * * * *